US007170232B2

(12) United States Patent
Miwa et al.

(10) Patent No.: US 7,170,232 B2
(45) Date of Patent: Jan. 30, 2007

(54) DISPLAY DEVICE AND METHOD OF DRIVING THE SAME

(75) Inventors: Kohichi Miwa, Yokohama (JP); Shinya Ono, Yokohama (JP); Yoshinao Kobayashi, Yamatoshi (JP)

(73) Assignees: Kyocera Corporation, Kyoto (JP); Chi Mei Optoelectronics Corp., Tainan County (TW)

( * ) Notice: Subject to any disclaimer, the term of this patent is extended or adjusted under 35 U.S.C. 154(b) by 33 days.

(21) Appl. No.: 11/153,445

(22) Filed: Jun. 16, 2005

(65) Prior Publication Data

US 2005/0280616 A1 Dec. 22, 2005

(30) Foreign Application Priority Data

Jun. 18, 2004 (JP) ..... 2004-181655

(51) Int. Cl.
*G09G 3/10* (2006.01)
*G09G 3/30* (2006.01)

(52) U.S. Cl. ..... 315/169.3; 345/76; 345/92; 345/204

(58) Field of Classification Search ..... 315/169.3, 315/169.1; 345/55, 76, 90, 92, 100, 202, 345/206, 208–212
See application file for complete search history.

(56) References Cited

U.S. PATENT DOCUMENTS

| | | | | |
|---|---|---|---|---|
| 6,376,994 | B1 * | 4/2002 | Ochi et al. | 315/169.1 |
| 6,617,801 | B2 * | 9/2003 | Ishizuka et al. | 315/169.3 |
| 6,858,992 | B2 * | 2/2005 | Park et al. | 315/169.3 |
| 2002/0089291 | A1 * | 7/2002 | Kaneko et al. | 315/169.3 |
| 2005/0017930 | A1 * | 1/2005 | Kobayashi et al. | 345/76 |
| 2005/0116655 | A1 * | 6/2005 | Yazawa | 315/169.3 |

FOREIGN PATENT DOCUMENTS

JP 2002-196357 A 7/2002

* cited by examiner

*Primary Examiner*—Trinh Vo Dinh
(74) *Attorney, Agent, or Firm*—Birch, Stewart, Kolasch & Birch, LLP

(57) ABSTRACT

A display device includes a driver circuit that controls so that an electric charge accumulation and a voltage detection/supply start simultaneously for a pixel circuit in a first row in the matrix and a pixel circuit in a second row in a matrix and adjacent to the pixel circuit in the first row in one direction along a column, and that controls so that the electric charge accumulation and the voltage detection/supply end simultaneously for the pixel circuit in the first row and a pixel circuit in a third row and adjacent to the pixel circuit in the first row in another direction along the column.

6 Claims, 7 Drawing Sheets

DISPLAY DEVICE AND METHOD OF DRIVING THE SAME

BACKGROUND OF THE INVENTION

1. Field of the Invention

The present invention relates to a display device including plural pixel circuits arranged in a matrix, each pixel circuit having a light-emitting element that emits light with a luminance corresponding to an amount of injected electric current and a transistor element that controls the amount of electric current flowing through the light-emitting element, the display device being formed to accumulate electric charges up to a predetermined capacitor and to detect/supply a voltage corresponding to a driving threshold voltage between a gate and a source of the transistor using the accumulated electric charges prior to the light emission by the light-emitting element. The present invention also relates to a method of driving such display device.

2. Description of the Related Art

An organic light-emitting display device which employs an organic light-emitting diode (OLED) that emits light by itself is the most appropriate device for the realization of flat screen display devices since such OLED eliminates the need of backlights required in liquid crystal displays. Further, the OLED has no restriction in viewing angle. Thus, the OLEDs attract attentions as the next-generation display device which would replace the liquid crystal display, and the practical application thereof is being waited for.

Known image display devices using the OLEDs are classified into a simple (passive) matrix type and an active matrix type. The former, though being advantageous for its simple structure, is not appropriate for realization of large high-resolution display devices. Thus in recent years, the development efforts concentrate on the active matrix type display device which controls electric currents flowing through light-emitting elements in pixels by active elements provided in the pixels, such as driver elements formed from thin film transistors (see Japanese Patent Laid-Open No. 2002-196357, for example).

FIG. 7 is a circuit diagram of a structure of a pixel circuit corresponding to a single pixel in a conventional image display device. The single pixel will be referred to as a sub-pixel for one of R, G, and B in one pixel if the display device is a color display below. As shown in FIG. 7, a pixel circuit 100 includes an OLED 101 which function as a light-emitting element, a driver element 102 which serves to determine an amount of electric current flowing through the OLED 101, a first switching element 103 which serves to control driving state of the driver element 102, a second switching element 104 and a third switching element 105 which functions at a threshold voltage detection described later, and a capacitor 106 arranged between a gate electrode and a source electrode of the driver element 102. Further, the conventional display device has a structure in which electric signals are supplied for drive control from a driver circuit 112 via a low potential supplying line 107, a high potential supplying line 108, a scan line 109, a first control line 110, a second control line 111, and a data line 113 to the pixel circuit elements described above.

The driver circuit 112 serves to supply electric signals for the control of the driving state of the elements in the pixel circuit 100. Specifically, the respective circuit elements in the pixel circuit 100 has functions such as: supplying a driving threshold voltage of the driver element 102 in advance; accumulating a predetermined amount of electric charges for the OLED 101 prior to the supply of the driving threshold voltage; supplying a potential corresponding to a gradation level of the OLED 101 to the driver element 102; and supplying a voltage between an anode and a cathode of the OLED 101 to let the OLED 101 emit light with luminance corresponding to the gradation level. The driver circuit 112 supplies predetermined electric signals via elements such as the low potential supplying line 107 to realize these functions.

The conventional display device with the OLEDs, however, has a large number of wirings extending from the driver circuit 112 as an interconnection structure, whereby the improvement in aperture ratio of each pixel is difficult to achieve. Inconveniences faced in the conventional display device will be described in detail below.

The conventional display device is structured so that the plural pixel circuits 100 are arranged in a matrix. Operations such as the supply of the driving threshold voltage by the driver element 102 are performed in each of the plural pixel circuits 100. Here, in the conventional display device, data voltage is supplied sequentially to the pixel circuits arranged in one row via a single data line 113. Then, the operations such as the supply of the driving threshold voltage is performed simultaneously to the pixel circuits 100 arranged in the same row, while such operations are performed at different timings corresponding to the supply of data voltage to the pixel circuits 100 arranged in different rows.

Hence, the conventional display device needs to adopt a structure where electric signals can be supplied separately and independently to the pixel circuits 100 in different rows. Specifically, the low potential supplying line 107, the high potential supplying line 108, the scan line 109, the first control line 110, and the second control line 111 as many as the number of the rows in the matrix of the pixel circuits 100 are required. Each of the elements 107 to 111 is arranged to extend in a column direction from one end of an array substrate on which the pixel circuits 100 are arranged in a matrix to another end, in order to supply electric signals to all pixel circuits 100 in the same row.

Thus, the interconnection structure occupies extremely large area on the array substrate. As the area occupied by the interconnection structure increases, the area of the light-emitting surface of the OLED 101 decreases accordingly. Then the improvement in aperture ratio is difficult to achieve. On the other hand, if a single common line is provided as each of signal supplying lines such as the low potential supplying line 107 which supply the electric signals to the pixel circuits 100 arranged in different rows, the improvement in aperture ratio is allowed. However, such structure creates another problem, i.e., the level of the driving threshold voltage supplied by the driver element 102 fluctuates, for example, to deteriorate the display image quality.

SUMMARY OF THE INVENTION

A display device according to one aspect of the present invention includes a plurality of pixel circuits, arranged in a matrix, each of which includes a light-emitting element that emits light with a luminance depending on an injected electric current, and a transistor that controls the electric current flowing through the light-emitting element, each of the pixel circuits performing prior to emission of light by the light-emitting element an electric charge accumulating operation in which a voltage between a gate and a source of the transistor is raised to a level higher than a driving threshold voltage of the transistor through accumulation of electric charges to a predetermined capacitor, and each of the pixel circuits performing a voltage detecting/supplying operation in which a voltage corresponding to the driving threshold voltage is detected/supplied between the gate and the source of the transistor through adjustment of the voltage between the gate and the source; and a driver circuit that controls at least a timing of detection and supply of a voltage corresponding to electric charge accumulation and the driving threshold voltage in the pixel circuit. The driver circuit controls so that the electric charge accumulation and the voltage detection/supply start substantially simultaneously for a pixel circuit in a first row in the matrix and a pixel circuit in a second row in the matrix and adjacent to the pixel circuit in the first row in one direction along a column, and controls so that the electric charge accumulation and the voltage detection/supply end substantially simultaneously for the pixel circuit in the first row and a pixel circuit in a third row and adjacent to the pixel circuit in the first row in another direction along the column.

A method according to another aspect of the present invention is for driving a display device which includes plural pixel circuits, arranged in a matrix, each of which includes a light-emitting element that emits light with a luminance depending on an injected electric current and a transistor that controls the electric current flowing through the light-emitting element, and which is configured to accumulate electric charges to a predetermined capacitor and to employ the accumulated electric charges to detect/supply a voltage corresponding to a driving threshold voltage between a gate and a source of the transistor element prior to emission of light by the light-emitting element. The method includes starting an electric charge accumulation and a voltage detection/supply substantially simultaneously for the pixel circuit arranged in a first row in the matrix and for the pixel circuit arranged in a second row adjacent to the first row in one direction along a column direction; and stopping the electric charge accumulation and the voltage detection/supply substantially simultaneously for the pixel circuit arranged in the first row in the matrix and the pixel circuit arranged in a third row adjacent to the first row in another direction along the column direction.

The display and the method of driving the display according to the present invention allows the downsizing of the interconnection structure which serves to transmit the electric signals to the pixel circuit to determine the start timing and the end timing of each process. Specifically, according to the display and the method of driving the display according to the present invention, the same start timing of the electric charge accumulation and the same start timing of the voltage detection/supply corresponding to the threshold voltage are set for the pixel circuits arranged in the first row and the second row, and the same end timing of the electric charge accumulation and the same end timing of the voltage detection/supply corresponding to the threshold voltage are set for the pixel circuits arranged in the first row and the third row. In addition, when the timings are determined in the above-described manner, the variation in the time length required for the electric charge accumulation is same with the variation in the time length required for the voltage detection/supply in the pixel circuits in the adjacent row. Hence, the variation in the source potential of the transistor element caused by the increase or the decrease in the time length required for the electric charge accumulation is offset by the variation in the source potential of the transistor element caused by the increase or the decrease in the voltage detection/supply, whereby the variation in the gate-to-source voltage can be suppressed as a whole. Thus, according to the invention recited in claim 1, regardless of the reduction in the number of wirings supplying the electric signals to the pixel circuits, the variation in the gate-to-source voltage among the pixel circuits arranged in the different rows can be suppressed and the deterioration of the display image quality can be suppressed.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary preferred embodiments (hereinafter simply referred to as embodiments) of a display device according to the present invention will be described below with reference to the drawings. It should be noted that the drawings are exemplary only and may be different from an actual structure, and may be different in dimension or proportion with each other. Though an n-channel thin film transistor will be described as a component of the embodiment, a p-channel transistor of course is adoptable for the present invention. Further in the following description, when electrodes other than a gate electrode of the thin film transistor are functionable either as a source electrode or a drain electrode, such structure is referred to as a source/drain electrode.

Figure 1:
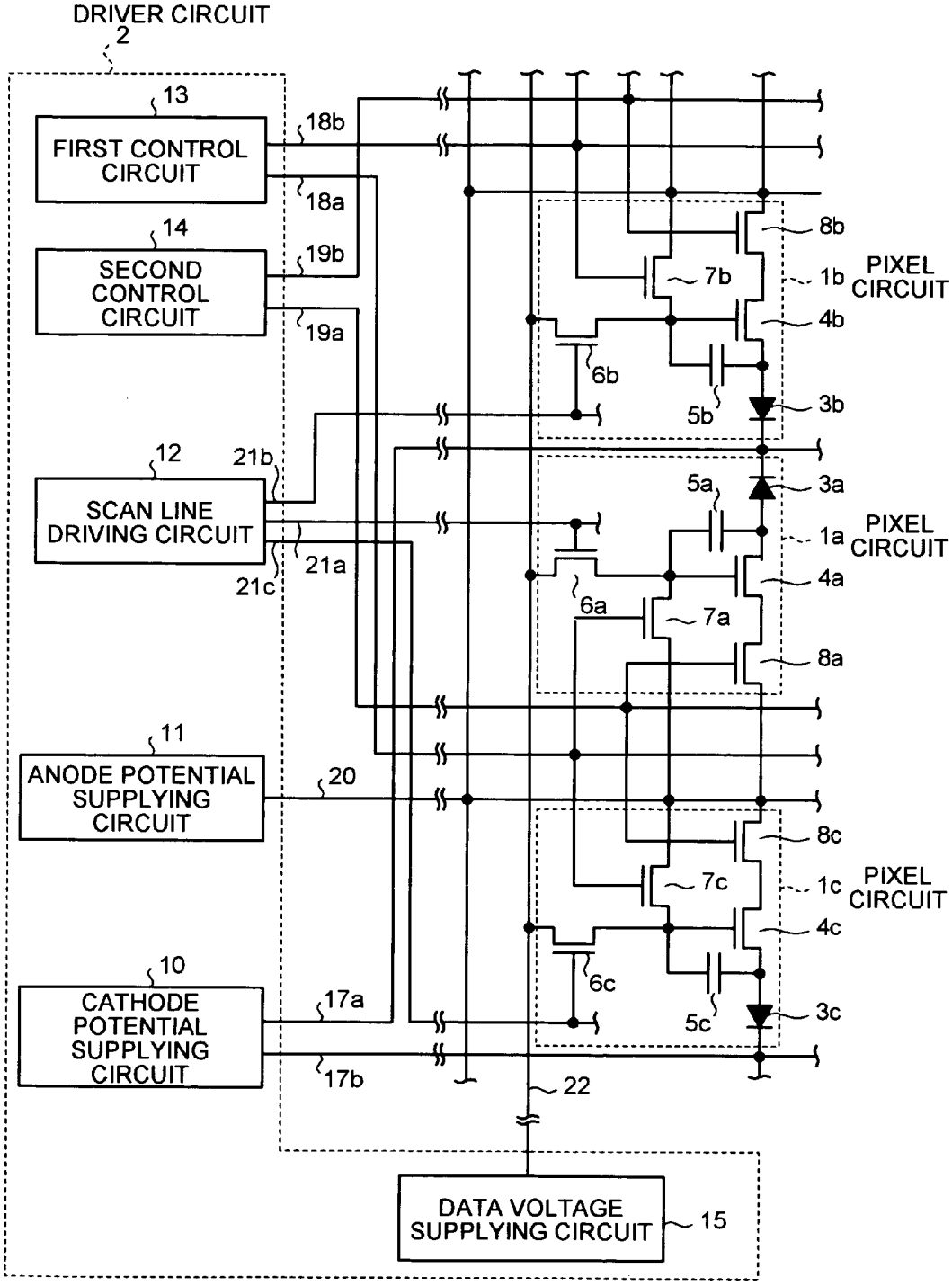
FIG. 1 is a schematic diagram of an overall structure of a display according to an embodiment.

A display device according to the embodiment includes pixel circuits arranged as a matrix. Plural pixel circuits arranged in different rows share a part of interconnection structure which supplies electric signals. Through an advantageous sharing manner of interconnection structure, degradation of visual quality of display image is suppressed to an unnoticeable degree and a higher aperture ratio is realized. FIG. 1 is a schematic diagram of a structure of the display device according to the embodiment. Here, the pixel circuits are arranged in matrix corresponding to a number of pixels of the display image. It should be noted that FIG. 1 does not intend to limit the number of pixel circuits forming the matrix.

The display device according to the embodiment includes, as shown in FIG. 1, plural pixel circuits 1*a*, 1*b*, 1*c*, . . . (hereinafter collectively referred to as "pixel circuits 1", or each of which is also referred to as "pixel circuit 1") arranged in a matrix, and a driver circuit 2 which supplies predetermined electric signals to the pixel circuits 1. FIG. 1 shows the pixel circuits 1*a*, 1*b*, and 1*c* among pixel circuits 1 arranged in a matrix of M rows by N columns (here, M and N are integers), respectively arranged at $m^{th}$ row, $n^{th}$ column, $(m-1)^{th}$ row, $n^{th}$ column, and $(m+1)^{th}$ row, $n^{th}$ column (here, m is an integer satisfying the expression $1<m\leqq M$, and n is an integer equal to or smaller than N).

Next, the structure of the pixel circuit 1 will be described. Since the pixel circuits 1*a*, 1*b*, and 1*c* of the embodiment have the same structure, the pixel circuit la alone will be described as an example. The pixel circuit 1*a* includes an OLED 3*a* which emits light in accordance with the amount of injected electric current, a thin film transistor 4*a* having a source electrode connected to the anode of the OLED 3*a* and serving as a driver element that controls the amount of electric current flowing through the OLED 3*a*, and a capacitor 5*a* connected to the gate electrode and the source electrode of the thin film transistor 4*a*. Here, the pixel circuit 1*a* includes a first switching element 6*a* which controls the driving state of the thin film transistor 4*a*, and a second switching element 7*a* and a third switching element 8*a* which function during an electric charge accumulating process and a threshold voltage detecting process described later.

The OLED 3*a* serves as a light-emitting element and a capacitor. The OLED 3*a* emits light when a voltage is applied in a forward direction and electric current is generated, and also serves as a capacitor when a voltage is applied in a backward direction. Specifically, the OLED 3*a* has a laminated structure of an anode layer, a light-emitting layer, and a cathode layer formed in this order. The light-emitting layer serves to recombine electrons injected from the cathode layer side and positive holes injected from the anode layer side for emitting the light. More particularly, the OLED 3*a* is made of an organic material such as phthalcyanine, tris aluminum complex, benzoquinolinolato, and beryllium complex, with a predetermined impurity added as necessary. Further, a positive hole transport layer and an electron transport layer may be provided respectively to the anode side and the cathode side of the light-emitting layer.

The thin film transistor 4*a* serves as a driver element and corresponds to a transistor element. The thin film transistor 4*a* has a source electrode connected to the anode of the OLED 3*a* as shown in FIG. 1, and controls the luminance of the emitted light through the control of electric currents flowing through the OLED 3*a* in accordance with the voltage applied to the gate electrode.

The first switching element 6*a* serves to control electric connection between the gate electrode of the thin film transistor 4*a* and a data voltage supplying circuit 15 (described later). Specifically, the first switching element 6*a* electrically connects the data voltage supplying circuit 15 and the gate electrode of the thin film transistor 4*a* during a data voltage writing process which will be described later, and controls the connection so that the data voltage is provided from the data voltage supplying circuit 15 to the gate electrode of the thin film transistor 4*a*. Here, the first switching element 6*a* is formed with a thin film transistor, for example, and the gate electrode thereof is electrically connected to a scan line driving circuit 12 described later. With such structure, the first switching element 6*a* can control the conduction according to the electric signals supplied from the scan line driving circuit 12.

The second switching element 7*a* serves to control electric connection between the gate electrode of the thin film transistor 4*a* and the anode potential supplying circuit 11 (described later), and the third switching element 8*a* serves to control electric connection between the drain electrode of the thin film transistor 4*a* and the anode potential supplying circuit 11. Specifically, the second switching element 7*a* and the third switching element 8*a* function during the electric charge accumulating process and the threshold voltage detecting process described later, and the operation thereof is controlled respectively by a first control circuit 13 and a second control circuit 14 described later. Here, the second switching element 7*a* and the third switching element 8*a* are formed similarly to the first switching element 6*a* with a thin film transistor, for example, and operate by receiving the electric signals from the first control circuit 13 or the like on the gate electrode.

Next, the driver circuit 2 will be described. The driver circuit 2 serves to control the light-emitting state of the OLED 3 in the pixel circuit 1 by supplying predetermined electric signals to the pixel circuit 1. The driver circuit 2 is configured with plural circuits, and includes in particular a cathode potential supplying circuit 10 supplying a potential to the cathode side of the OLED 3, the anode potential supplying circuit 11 supplying a potential to the anode side of the OLED 3, the scan line driving circuit 11 controlling the driving state of the first switching element 6 in the pixel circuit 1, the first control circuit 13 controlling the driving state of the second switching element 7, the second control circuit 14 controlling the driving state of the third switching element 8, and the data voltage supplying circuit 15 supplying a data voltage corresponding to the gradation level.

The cathode potential supplying circuit 10 serves to control the potential on the cathode side of the OLED 3. The cathode potential supplying circuit 10 fulfills a predetermined function by supplying to the cathode of the OLED 3 a potential lower than the potential supplied from the anode potential supplying circuit 11, to generate a forward voltage supply thereby causing the OLED 3 emit light, and additionally changing the level of the supplied potential in the electric charge accumulating process and the threshold voltage detecting process described later. The function of the cathode potential supplying circuit 10 in the electric charge accumulating process or the like will be described later.

The anode potential supplying circuit 11 serves to control the potential on the anode side of the OLED 3. Specifically, the anode potential supplying circuit 11 is electrically connected to the anode of the OLED 3 via the thin film transistor 4 and the third switching element 8, and supplies a potential to the anode of the OLED 3 when the switching element 8 is in ON state. In the embodiment, the anode potential supplying circuit 11, being different from other circuits in the driver circuit 2, is configured to supply a potential of a fixed level.

The scan line driving circuit 12 serves to control the driving of the first switching element 6 in the pixel circuit 1. Specifically, the scan line driving circuit 12 controls the switching between ON state and OFF state of the first switching element 6 by supplying a predetermined electric signal for scanning to the first switching element 6 in the pixel circuit 1.

The first control circuit 13 serves to control the driving of the second switching element 7 in the pixel circuit 1, and the second control circuit 14 serves to control the driving of the third switching element 8. As described later, the second switching element 7 and the third switching element 8 operate to perform predetermined functions in the electric charge accumulating process and the threshold voltage detecting process. The first control circuit 13 and the second control circuit 14 function as to control the timing of switching between ON state and OFF state of the second switching element 7 and the third switching element 8, respectively, by supplying predetermined electric signals.

The data voltage supplying circuit 15 serves to output the data voltage at a level corresponding to the luminance of light emitted from the OLED 3 in the pixel circuit 1. The OLED 3 receives electric currents of an amount controlled by the thin film transistor 4 which serves as a driver element. Here, the thin film transistor 4 has a characteristic that the amount of electric current flowing between the drain and the source is determined according to the level of the gate-to-source voltage. The OLED 3 receives the electric current flowing through the drain and the source of the thin film transistor 4. Therefore, through the control of the gate-to-source voltage of the thin film transistor 4, the control of the amount of the electric current flowing through the OLED 3, and hence, the control of the luminance of light emitted from the OLED 3 can be achieved. The data voltage supplying circuit 15 has a function of supplying the data voltage which determines the gate-to-source voltage of the thin film transistor 4.

Next, electric connection between elements in the pixel circuits and the driver circuit 2 will be described. The relation between the respective circuits in the driver circuit 2 and the respective elements of the pixel circuit 1 is as described above. For example, the respective second switching element 7*a*, 7*b* and 7*c* have the driving state controlled by the electric signals supplied from the first control circuit 13 to achieve a similar function in the pixel circuits 1*a*, 1*b*, and 1*c*.

The elements in the pixel circuit 1, however, may have different operation timings though the function is the same. Same or different electric signals may be supplied to different pixel circuits 1. The electric connection between the pixel circuits 1*a*, 1*b*, and 1*c* and the driver circuit 2 as shown in FIG. 1 allows the suppression of degradation of display image quality to an unrecognizable level and reduction of the number of wirings connecting the pixel circuits 1 and the driver circuit 2 as described later. Hereinbelow, the specific connection between the respective elements in the driver circuit 2 and the pixel circuits 1*a*, 1*b*, and 1*c* will be described.

The interconnection structure between the pixel circuits 1*a* and 1*b* and the cathode potential supplying circuit 10 is different from the interconnection structure between the pixel circuit 1*c* and the cathode potential supplying circuit 10. As shown in FIG. 1, cathode potential lines 17*a* and 17*b* each extend from the cathode potential supplying circuit 10 to transmit a different electric signal. The cathode potential line 17*a* is connected to the cathode of the OLED 3*a* in the pixel circuit 1*a* and the cathode of the OLED 3*b* in the pixel circuit 1*b*. On the other hand, the cathode potential line 17*b* is connected to the cathode of the OLED 3*c* of the pixel circuit 1*c*. The cathodes of the OLEDs 3*a* and 3*b* respectively of the pixel circuits 1*a* and 1*b* receive different electric signal from the electric signal supplied to the cathode of the OLED 3*c* of the pixel circuit 1*c*.

On the other hand, the first control circuit 13 has a different connection structure with the pixel circuit 1 from that of the cathode potential supplying circuit 10. Specifically, while the interconnection structures between the first control circuit 13 and the pixel circuits 1*a* and 1*c* are the same, the interconnection structure between the first control circuit 13 and the pixel circuit 1*b* is different from the other two. First control lines 18*a* and 18*b* each extend from the first control circuit 13 to transmit a different electric signal. The first control line 18*a* is connected to the gate electrode of the second switching element 7*a* in the pixel circuit 1*a* and the gate electrode of the second switching element 7*c* of the pixel circuit 1*c*. On the other hand, the first control line 18*b* is connected to the gate electrode of the second switching element 7*b* of the pixel circuit 1*b*. Thus, the electric signal supplied to the gate electrodes of the second switching elements 7*a* and 7*c* respectively of the pixel circuits 1*a* and 1*c* is different from the electric signal supplied to the gate electrode of the second switching element 7*b* of the pixel circuit 1*b*.

The second control circuit 14 has a connection structure which is similar to that of the first control circuit 13 and different from that of the cathode potential supplying circuit 10. Second control lines 19*a* and 19*b* extend from the second control circuit 14. The second control line 19*a* is connected to the gate electrode of the third switching element 8*a* of the pixel circuit 1*a* and the gate electrode of the third switching element 8*c* of the pixel circuit 1*c*, whereas the second control line 19*b* is connected to the gate electrode of the third switching element 8*b* of the pixel circuit 1*b*.

The connection structures of the anode potential supplying circuit 11 and the scan line driving circuit 12 to the pixel circuit 1 are different from that of the above described circuits. Specifically, the anode potential supplying circuit 11 is connected to the drain electrodes of the third switching elements 8*a*, 8*b*, and 8*c* of pixel circuit 1*a*, 1*b*, and 1*c* via a single anode potential line 20. Such connection structure is preferable since the anode potential supplying circuit 11 of the embodiment supplies a fixed potential. On the other hand, three scan line driving lines 21*a*, 21*b*, and 21*c* extend from the scan line driving circuit 12. The scan line driving line 21*a* is connected to the gate electrode of the first switching element 6*a* of the pixel circuit 1*a*, the scan line driving line 21*b* is connected to the gate electrode of the first switching element 6*b* of the pixel circuit 1*b*, and the scan line driving line 21*c* is connected to the gate electrode of the first switching element 6*c* of the pixel circuit 1*c*. Such connection structure intends to turn the first switching element 6*a*, 6*b*, and 6*c* into ON state at different timings in order to supply the data voltage of different levels to respective pixel circuits 1*a*, 1*b*, and 1*c* since the data voltage is supplied via the same single data line 22.

Next, operation of the display device according to the embodiment will be described. Hereinbelow, the operation of a single pixel circuit will be first described with focus on the relation between the pixel circuit 1 and the driver circuit 2, with the pixel circuit 1*a* as an example. Then, relation between the operations of respective pixel circuits 1*a*, 1*b*, and 1*c* related with the different connection structures with the driver circuit 2 will be described.

Figure 2:
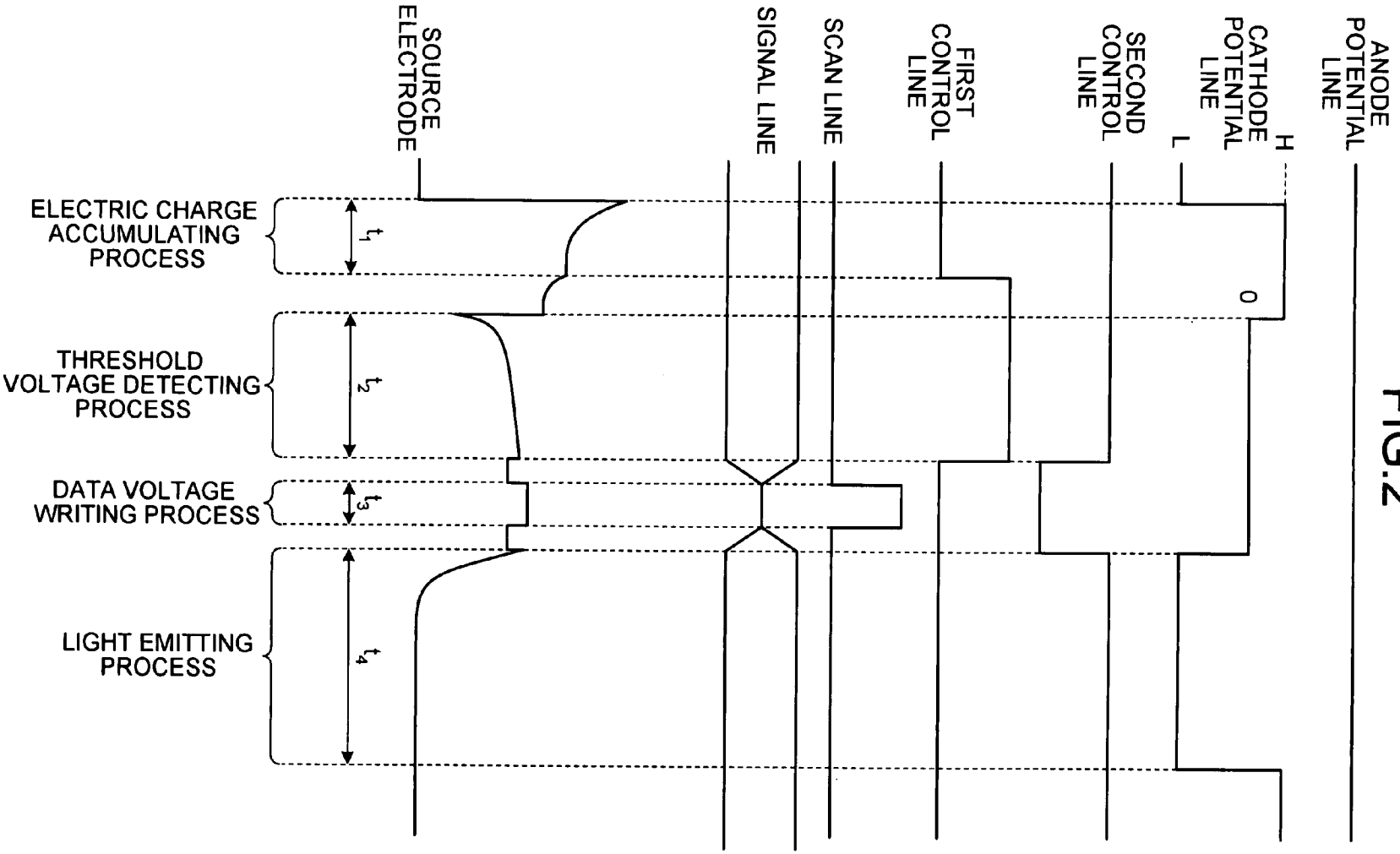
FIG. 2 is a timing chart of temporal variations of a source potential of a thin film transistor in a single pixel circuit and of electric signals supplied to the pixel circuit.

First, the operation of the pixel circuit 1*a* will be described as an example of the pixel circuit 1 in general. FIG. 2 is a timing chart of temporal changes of electric signals supplied from circuits in the driver circuit 2 to the pixel circuit 1*a*, and a timing chart of temporal changes of potential on the source electrode (i.e., the electrode connected to the anode of the OLED 3*a*) of the thin film transistor 4*a* caused by the supply of electric signals from the driver circuits 2. In the following, the operation of the pixel circuit 1*a* will be described with reference to FIG. 2.

The operation of the pixel circuit 1 is divided specifically into four processes: the electric charge accumulating process in which the backward voltage is supplied to the OLED 3*a* for electric charge accumulation; the threshold voltage detecting process in which the driving threshold voltage between the gate and the source of the thin film transistor 4*a* is detected and written; a data voltage writing process in which the data voltage of a level corresponding to the luminance of the display is written between the gate and the source of the thin film transistor 4*a*; and a light-emitting process in which an electric current of an amount corresponding to the written data voltage is supplied to the OLED 3*a* to cause light emission of a predetermined luminance. More specifically, the electric charge accumulating process, the threshold voltage detecting process, the data voltage writing process, and the light-emitting process are respectively conducted over time lengths t1, t2, t3, and t4, as shown in FIG. 2. Next, brief descriptions of respective processes will be provided.

In the electric charge accumulating process, backward voltage is supplied to the OLED 3*a* and the OLED 3*a* is made to function as a capacitor. Thus, a predetermined amount of electric charges is accumulated. Specifically, the potential on the cathode potential line 17*a* is increased above the potential on the anode potential line 20, thereby causing the backward voltage supply to the OLED 3*a* and starting the electric charge accumulating process. During this process, when the potential on the second control line 19*a* attains a logic "high", the third switching element 8a turns into ON state. When the potential on the first control line 18*a* is maintained a logic "low", the second switching element 7*a* remains in OFF state. The potential on the scan line 21*a* is maintained in a "low" state to keep the first switching element 6*a* in OFF state.

When the circuit structure is maintained in a state as described above, the positive electric charges are accumulated on the cathode side of the OLED 3*a* while the negative electric charges are accumulated on the anode side. Then the source potential of the thin film transistor 4a gradually lowers as shown in FIG. 2.

When the electric charge accumulating process completes, the gate-to-source voltage of the thin film transistor 4*a* is higher than the driving threshold voltage thereby rendering the thin film transistor 4*a* in ON state. With the change of the potential on the first control line 18*a* to a logic "high", the electric charge accumulating process completes and the electric charge accumulation conducted over the time length $t_1$ ends.

Following the electric charge accumulating process, the threshold voltage detecting process is performed. In the threshold voltage detecting process, the driving threshold voltage between the gate and the source of the thin film transistor 4*a* is detected and supplied. Specifically, as shown in FIG. 2, the potential on the cathode potential line 17*a* lowers down to zero to start the threshold voltage detecting process. During the process, the potentials on the first control line 18*a* and the second control line 19*a* are maintained a logic "high", to keep the second switching element 7*a* and the third switching element 8*a* in ON state. The potential on the scan line 21*a* is maintained a logic "low" to keep the first switching element 6*a* in OFF state.

Thus, the gate electrode of the thin film transistor 4*a* is electrically insulated from the data line 22 and connected to the drain electrode of the thin film transistor 4*a* via the second switching element 7*a* and the third switching element 8*a*. Since the thin film transistor 4*a* is in ON state, the drain and the source of the thin film transistor 4*a* are electrically conducted via a channel therebetween. As a result, the gate electrode and the source electrode of the thin film transistor 4*a* are rendered conductive, to allow gradual supply of the positive electric charges accumulated on the gate electrode to the source electrode (i.e., anode of the OLED 3*a*), offsetting the negative electric charges accumulated during the electric charge accumulating process thereby gradually raising the potential on the source electrode. Thus, the gate-to-source voltage of the thin film transistor 4*a* gradually lowers to approach the driving threshold voltage. Specifically, the gate-to-source voltage changes by an amount of $V_2$ (<0).

The threshold voltage detecting process finishes with the potentials on the first control line 18*a* and the second control line 19*a* attain a logic "low". When the potentials of the first control line 18*a* and the second control line 19*a* are rendered a logic "low", the second switching element 7*a* and the third switching element 8*a* turn to OFF state to electrically insulate the connection between the gate electrode of the thin film transistor 4*a* and the anode potential line 20 thereby stopping the positive electric charge supply. Then, the gate-to-source voltage stops changing, and the level of the gate-to-source voltage at the end of the process is maintained as the driving threshold voltage between the gate and the source of the thin film transistor 4*a*.

Thereafter, the data voltage writing process and the light-emitting process follow. The potentials on the first control line 18*a* and the second control line 19*a* are maintained a logic "low", and the potential on the scan line 21*a* turns to a logic "high". Then, the gate electrode of the thin film transistor 4*a* is connected to the data line 22 via the first switching element 6*a*, whereas insulated from elements other than the data line 22 since the second switching element 7*a* is in OFF state. Thus, the data voltage is newly supplied from the data voltage supplying circuit 15 to the gate electrode of the thin film transistor 4*a*. Then, a voltage at a level corresponding to the sum of the threshold voltage supplied in the threshold voltage detecting process and the newly supplied data voltage is written between the gate and the source of the thin film transistor 4*a*. In the light-emitting process, the electric current of the amount controlled by the thin film transistor 4*a* to which the voltage is applied as described above is made to flow through the OLED 3*a*, and the OLED 3*a* emits light of a predetermined luminance.

Figure 3:
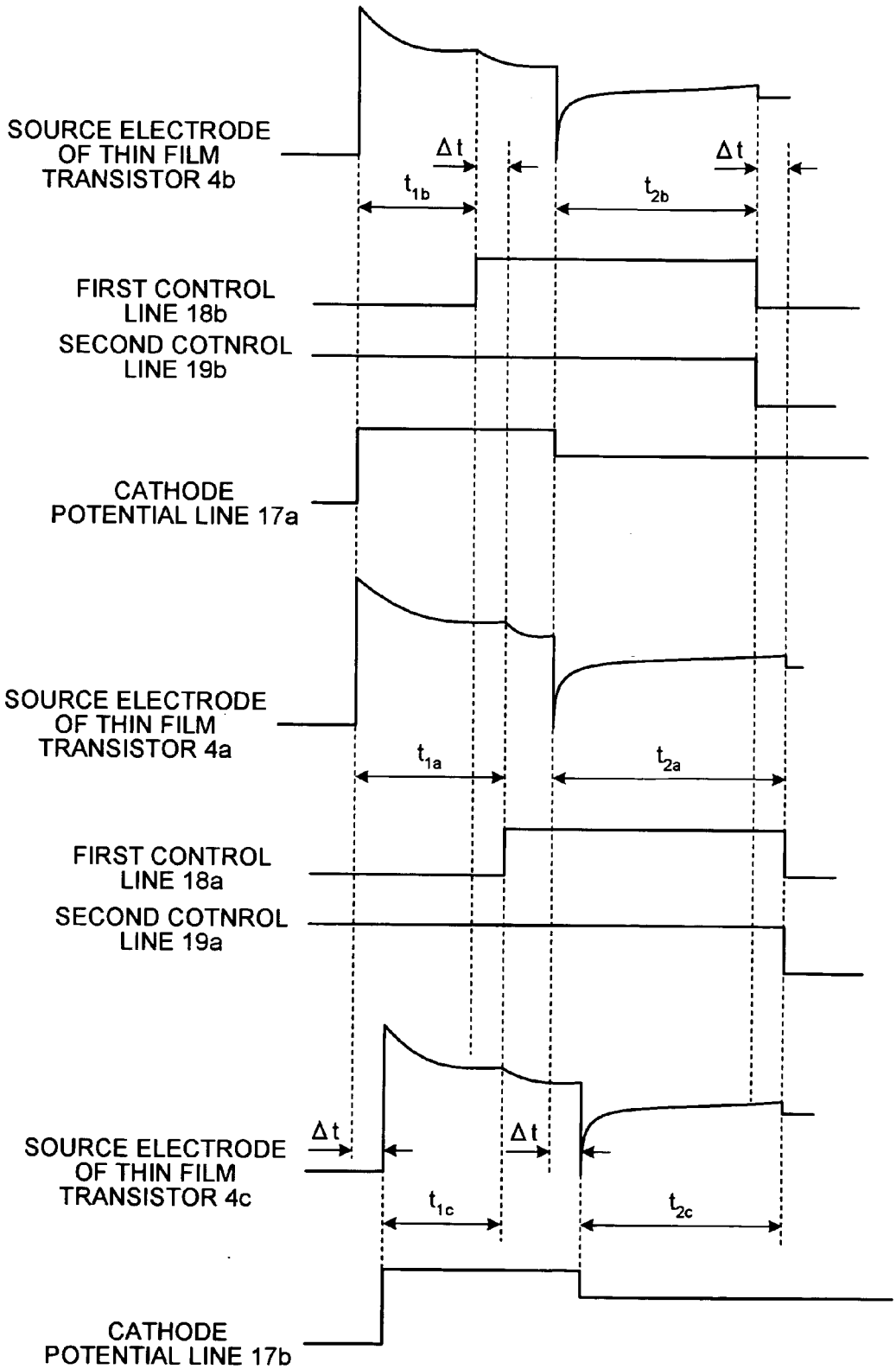
FIG. 3 is a timing chart showing relations between temporal variation of source potentials and timing of supply of electric signals in plural pixel circuits.

As can be seen from the foregoing, in the pixel circuit 1*a*, the potential change on the cathode potential line 17*a* is utilized to control the start timing of the electric charge accumulating process and the threshold voltage detecting process, and the potential changes on the first control line 18*a* and the second control line 19*a* are utilized to control the end timing of the electric charge accumulating process and the threshold voltage detecting process. With such control, the electric charge accumulating process continues over time length $t_1$ and the threshold voltage detecting process continues over time length $t_2$. During the electric charge accumulating process, the source potential $V_1$ of the thin film transistor 4*a* changes by a predetermine amount, whereas in the threshold voltage detecting process, the source potential $V_2$ of the thin film transistor 4*a* also changes by a predetermined amount. Next, relation between the pixel circuits 1*a*–1*c* in connection with the electric charge accumulating process and the threshold voltage detecting process will be described. FIG. 3 is a timing chart of potential variations in pixel circuits 1*a*, 1*b*, and 1*c* during the electric charge accumulating process and the threshold voltage detecting process, and in particular shows the potential variations on the cathode potential lines 17*a* and 17*b*, the first control lines 18*a* and 18*b*, the second control lines 19*a* and 19*b*, and the source electrodes of the thin film transistors 4*a*, 4*b*, and 4*c* in the respective pixel circuits 1*a*, 1*b*, and 1*c*.

As shown in FIG. 1, the pixel circuits 1*a* and 1*b* are structured so as to receive electric signals from the cathode potential supplying circuit 10 via the common cathode potential line 17*a*. On the other hand, different electric signals are supplied from the first control circuits 13 and the second control circuit 14 via different first control lines 18*a* and 18*b*, and different second control lines 19*a* and 19*b*.

Further, the pixel circuits 1*a* and 1*c* are structured to receive electric signals from the first control circuit 13 and the second control circuit 14 via the common first control line 18*a* and the common second control line 19*a* as shown in FIG. 1. The cathode potential supplying circuit 10 supplies different electric signals via different cathode potential lines 17*a* and 17*b*.

Further, as described above with reference to FIG. 2, the start timings of the electric charge accumulating process and the threshold voltage detecting process are controlled by the electric signals supplied via the cathode potential line 17, whereas the end timings of the electric charge accumulating process and the threshold voltage detecting process are controlled by the electric signals supplied via the first control line 18 and the second control line 19.

Specifically, as shown in FIG. 3, the pixel circuit 1*b* has the same start timings of the electric charge accumulating process and the threshold voltage detecting process with the pixel circuit 1*a*, while the end timing thereof is Δt earlier than that of the pixel circuit 1*a*. Thus, the pixel circuit 1*b* has Δt shorter time lengths $t_{1b}$ and $t_{2b}$ respectively for the electric charge accumulating process and the threshold voltage detecting process compared with the time lengths $t_{1a}$ and $t_{2a}$ of the pixel circuit 1*a*.

The similar relation holds between the pixel circuit 1*a* and the pixel circuit 1*c*. The pixel circuit 1*c* has the same end timings of the electric charge accumulating process and the threshold voltage detecting process with the pixel circuit 1*a*, while the start timings thereof are Δt later that of the pixel circuit 1*a*. Hence, the pixel circuit 1*c* has Δt shorter time lengths $t_{1c}$ and $t_{2c}$ respectively for the electric charge accumulating process and the threshold voltage detecting process compared with the time lengths $t_{1a}$ and $t_{2a}$ of the pixel circuit 1*a*.

The relation between the time length $t_1$ required for the electric charge accumulating process and the time length $t_2$ required for the threshold voltage detecting process, and variation of the source potentials $V_1$ and $V_2$ in each process will be described. As described above, in the electric charge accumulating process, the OLED 3 receives the backward voltage to function as a capacitor. As is clear from the variation of the source potential during the time period with the time length $t_1$ in FIG. 2, the source potential in the thin film transistor 4 at the end of the electric charge accumulating process depends on the value of the time length $t_1$. In other words, if the time length $t_1$ required for the electric charge accumulating process varies, the source potential $V_1$ varies accordingly.

The same applies to the threshold voltage detecting process. The threshold voltage detecting process starts when the gate-to-source voltage of the thin film transistor 4 is higher than the driving threshold, and aims at gradually decreasing the gate-to-source voltage to the level of the driving threshold. As is clear from the change in the source potential during the time period with the time length $t_2$ in FIG. 2, during the threshold voltage detecting process, the gate-to-source voltage of the thin film transistor 4 monotonously decreases over time. Thus, the gate-to-source voltage of the thin film transistor 4 at the end of the threshold voltage detecting process depends on the value of the time length $t_2$. Hence, when the time length $t_2$ required for the threshold voltage detecting process varies, the source potential $V_2$ varies accordingly.

Here, it is possible to assume that the absolute value of the gate-to-source voltage at the start of the electric charge accumulating process and the variation in the gate-to-source voltage in the period from the end of the electric charge accumulating process to the start of the threshold voltage detecting process are substantially fixed. Then, if the time lengths $t_1$ and $t_2$ are different from each other, the gate-to-source voltage of the thin film transistor 4 at the end of the threshold voltage detecting process becomes different. Specifically, a voltage of a level corresponding to the variation of $V_1$ and variation of $V_2$ are produced between the thin film transistor 4*a*, 4*b*, and 4*c* respectively in the pixel circuits 1*a*, 1*b*, and 1*c*.

In the embodiment, each pixel circuit 1 displays an image by adding the data voltage to the gate-to-source voltage present at the end of the threshold voltage detecting process. Hence, even when the data voltage of the same level is supplied to the pixel circuits 1*a*–1*c* to display the same color, if the difference in the gate-to-source voltage among the pixel circuits at the end of the threshold voltage detecting process is unignorable, each pixel circuit displays different color thereby giving uncomfortable sensation to the viewer.

On the other hand, when the display device has a structure as in the embodiment where the cathode potential line 17, the first control line 18, and the second control line 19 are shared among adjacent pixel circuits 1, it is difficult to make the time length $t_1$ and the variation of the source potential $V_1$ during the electric charge accumulating process and the time length $t_2$ and the variation of the source potential $V_2$ during the threshold voltage detecting process equal in all pixel circuits 1. Hence, provided that the variations of $V_1$ and $V_2$ are different from each other, the embodiment intends to reduce the difference in displayed colors caused by the difference in the above-described values to the degree that the viewer would not have uncomfortable feeling.

First, the embodiment does not adopt the structure in which one pair of pixel circuits 1 arranged in adjacent rows (pixel circuits 1*a* and 1*c*, for example) shares all of the cathode potential line 17, the first control line 18 and the second control line 19, and another pair (pixel circuits 1*a* and 1*c*, for example) uses different lines. As shown in FIG. 1, the embodiment adopts the structure where one pair shares a part of the interconnection while another pair shares the remaining part of the interconnection.

With such structure, the number of wirings can be reduced, and the difference in displayed color in a column direction can be made uniform. As shown in FIG. 3, the difference in time lengths of the electric charge accumulating process between the pixel circuit 1*a* and the pixel circuit 1*b*, or between the pixel circuit 1*a* and the pixel circuit 1*c* takes a fixed value Δt in either pair of adjacent pixel circuits. The same applies to the threshold voltage detecting process. The difference in time lengths of the threshold voltage detecting process between the adjacent pixel circuits, i.e., between the pixel circuit 1*b* and the pixel circuit 1*a*, or between the pixel circuit 1*a* and the pixel circuit 1*c* takes a fixed value Δt as shown in FIG. 3.

Thus in the embodiment, the difference in time lengths of each process between the pixel circuits in adjacent rows is fixed. Then, even when the difference in displayed color is generated due to the difference in the time length regardless of the supply of the same data voltage, the variation of displayed color is uniformly caused among pixel circuits. Then, there is no notable difference in displayed colors from pixel circuit to pixel circuit, whereby it is possible to reduce the probability of generation of the viewers, uncomfortable sensation.

Further in the embodiment, the pixel circuits 1*a* and 1*b* share the cathode potential line 17*a*, whereas the pixel circuits 1*a* and 1*c* share the first control line 18*a* and the second control line 19*a*. With such sharing, the degree of variation in displayed colors produced between the pixel circuits 1*a* and 1*b*, or between the pixel circuits 1*a* and 1*c* can be suppressed.

Since the source potential of the thin film transistor 4 monotonously increases over time during the electric charge accumulating process, the value of the source potential increases together with the increase in the time length $t_1$ for the electric charge accumulating process. On the other hand, since the source potential monotonously decreases over time during the threshold voltage detecting process, the value of the source potential of the thin film transistor 4 decreases together with the increase in the time length $t_2$ for the threshold voltage detecting process.

In view of such relation, the embodiment makes the start timings of the electric charge accumulating process and the threshold voltage detecting process in one pair of adjacent pixel circuits (pixel circuits 1*a* and 1*b*, for example) the same by providing the shared cathode potential line, whereas makes the end timings of the electric charge accumulating process and the threshold voltage detecting process for another pair of adjacent pixel circuits (pixel circuits 1*a* and 1*c*, for example) the same by providing the shared first control line and second control line.

In such structure, the time length of the threshold voltage detecting process in a pixel circuit increases if the time length of the electric charge accumulating process becomes longer than that in a reference pixel circuit adjacent thereto. In the example of FIG. 3, provided that the pixel circuit 1*b* is the reference circuit, for example, the time length of the electric charge accumulating process as well as the time length of the threshold voltage detecting process of the pixel circuit 1*a* arranged in an adjacent row become longer than that in the pixel circuit 1*b*. As described above, in the pixel circuit 1, the increase in the time length of the electric charge accumulating process tends to accompany the increase in the source potential, whereas the time length of the threshold voltage detecting process tends to accompany the decrease in the source potential. Hence, when the pixel circuit 1 is structured so that the time lengths of both the electric charge accumulating process and the threshold voltage detecting process become longer than that in the adjacent pixel circuit 1, the increase in the source potential caused by the increase in the time length of the electric charge accumulating process is offset by the decrease in the source potential caused by the increase in the time length of the threshold voltage detecting process, whereby the degree of overall variation in the source potential can be reduced. The eventual value of the gate-to-source voltage of the thin film transistor 4 corresponds to the variation in the source potential over the whole process. Hence, the decrease in the difference in the variations of the source potentials among different pixel circuits leads to the decrease in the difference in the gate-to-source voltages of the thin film transistors provided in respective pixel circuits, whereby the difference in the displayed colors by different pixel circuits can also be reduced.

Further in the embodiment, the driver circuit 2 and the interconnection structure such as the cathode potential line 17 are arranged so that the difference in the time lengths of the electric charge accumulating process and the difference in the time lengths of the threshold voltage detecting process in adjacent pixel circuits are the same. With such structure, even when there is a difference in the time lengths of the electric charge accumulating process or the like, the variation in the displayed colors can be suppressed.

As shown in the timing chart of FIG. 2 of the source potential of the thin film transistor 4*a* in the electric charge accumulating process and the threshold voltage detecting process, the ratio of potential changes decreases as the process nears the end in both processes, and the absolute values of change ratios are substantially the same in both processes. Hence, when the difference in the time lengths of the electric charge accumulating process between adjacent pixel circuits and the difference in time lengths of the threshold voltage detecting process are equal with each other, the absolute values of variations in the source potentials in both processes become substantially same with each other. Then the difference in the gate-to-source voltages between the pixel circuits arranged in adjacent rows can be decreased over the electric charge accumulating process and the threshold voltage detecting process, and as a result, the difference in the displayed colors can be suppressed.

Further, the embodiment adopts a structure where the tolerance of the difference in variations of $V_1$ and $V_2$ between the adjacent pixel circuits is determined and the difference in the gate-to-source voltage of the thin film transistor 4 determined by the variations of $V_1$ and $V_2$ is suppressed to the level of tolerance. Thus, the variation of displayed colors is suppressed to an unrecognizable degree from the viewer. Hereinbelow, the tolerance of the difference in the gate-to-source voltage in the thin film transistor 4 generated by the difference in specific values of $V_1$ and $V_2$ in adjacent pixel circuits will be described in detail. In the following it is assumed that the adjacent pixel circuits are to display the same color, and the variation in the displayed colors is generated solely by the difference in the gate-to-source voltage at the end of the threshold voltage detecting process. In addition, in the following it is assumed that the display device is to exhibit the image in monotone and the difference in the displayed colors is equivalent to the difference in the luminance of the light emitted from the OLED 3 in the pixel circuits 1. Still additionally, the value of the electric current flowing through the OLED 3 is employed as an indicator of the difference in luminance of the light emitted from the OLED 3.

Here, it is assumed that one pixel circuit 1 (pixel circuit 1*b*, for example) is the reference circuit, and an adjacent pixel circuit (pixel circuit 1*a*, for example) is compared therewith. The difference in the amount of the electric current I flowing through the OLED 3 (OLED 3*b*, for example) in the reference pixel circuit and the amount of the electric current I flowing through the OLED 3 (OLED 3*a*, for example) in the compared pixel circuit is represented by ΔI. Then, the tolerance can be represented as:

$$\left|\frac{\Delta I}{I}\right| < k \tag{1}$$

where k is a value corresponding to the limit of viewer's cognition of the variation in the displayed color, and given as k=0.01, for example.

Here, the electric current I flowing through the OLED 3 at the time of light emission varies depending on the driving threshold voltage $V_{th}$ of the thin film transistor 4. Specifically with respect to the electric current I, the following relation holds:

$$\Delta I = \frac{\partial I}{\partial V_{th}} \Delta V_{th} = -\beta(V_{gs} - V_{th}) \cdot \Delta V_{th} \tag{2}$$

where $\Delta V_{th}$ is the difference in detected driving threshold voltages in the thin film transistors 4 in the pixel circuits arranged in adjacent rows. For the derivation of Expression (2), the relations which hold among the electric current value I, the driving threshold $V_{th}$, and the gate-to-source voltage $V_{gs}$ in general thin film transistor and are represented by Expressions (3) and (4) are employed:

$$I = \frac{\beta}{2}(V_{gs} - V_{th})^2 \tag{3}$$

$$\beta = \frac{\mu C_{ox} W}{L} \tag{4}$$

In Expression (4), μ is the mobility of electrons in the channel region of the thin film transistor, $C_{ox}$ is the capacitance of unit area of the thin film transistor, W is the channel width of the thin film transistor, and L is the channel length. Expression (1) can be transformed with Expression (2) into:

$$\left|\frac{\Delta I}{I}\right| = \frac{2}{V_{gs} - V_{th}}|\Delta V_{th}| = \frac{2}{V_{data}}|\Delta V_{th}| < k \tag{5}$$

Hence, the tolerance of variation in displayed colors can be derived by finding the variation of driving threshold voltage $V_{th}$ obtained through the electric charge accumulating process and the threshold voltage detecting process, and satisfying Expression (5).

In the electric charge accumulating process, the drain potential of the thin film transistor 4 is maintained zero, and the gate-to-source voltage is maintained at the level of the sum of the data voltage $V_{data}$ supplied at the display of the previous frame by the function of the capacitor 5 and the driving threshold $V_{th}$. Hence, in the electric charge accumulating process, the thin film transistor 4 operates in a "linear region," whereby the following general Formula (6) holds for the electric current $I_{charge}$ flowing between the source and the drain of the thin film transistor 4 during the electric charge accumulating process:

$$I_{charge} \approx \beta(V_{gd}(t) - V_{th}) \cdot V_{sd}(t) = \beta(V_g(t) - V_{th}) \cdot V_1(t) = \beta(V_{data}' + V_1(t)) \cdot V_1(t) \tag{6}$$

Then, since the electric current $I_{charge}$ is supplied to the OLED 3 which works as a capacitance of a capacitance value $C_{OLED}$, Expression (7):

$$I_{charge} = \frac{\partial V_1(t)}{\partial t} \tag{7}$$

holds. Based on Expressions (6) and (7), the source potential $V_1(t_1)$ of the thin film transistor 4 when the electric charge accumulating process continues over time length $t_1$ can be represented as:

$$V_1(t_1) = \frac{V_{data}'}{\exp\left(-\frac{\beta \cdot V_{data}'}{C_{OLED}} t_1 + \ln\left(1 + \frac{V_{data}'}{V_1(0)}\right)\right) - 1} \tag{8}$$

The source potential $V_2$ of the thin film transistor 4 at the end of the threshold voltage detecting process will be described. Since the gate potential and the drain potential of the thin film transistor 4 are maintained at a zero level during the threshold voltage detecting process, the thin film transistor 4 operates in a saturated region. Then, the electric current flowing between the drain and the source of the thin film transistor 4 at the threshold voltage detecting process satisfies the relation of Expression (9):

$$I_{vth} = \frac{\beta}{2}(-V_2(t) - V_{th})^2 = (C_s + C_{OLED})\frac{\partial V_2(t)}{\partial t} \tag{9}$$

Where $C_s$ is the capacitance of the capacitor 5. Then, the source potential can be represented, based on the solution of the differential Equation (9) as:

$$V_2(t) = -V_{th} + \frac{1}{\frac{1}{V_2(0) + V_{th}} - \frac{\beta}{2(C_s + C_{OLED})}t} \tag{10}$$

The value of the driving threshold voltage actually detected in the threshold voltage detecting process in the display device of the embodiment is $V_2(t_2)$. Then, the value of the difference $\Delta V_{th}$, represented by Expression (5) or the like, between the driving threshold voltages $V_{th}$ in pixel circuits arranged in adjacent rows can be represented based on Expression (10) as:

$$\Delta V_{th} = \frac{\partial V_2(t_2)}{\partial t_2}\Delta t_2 + \frac{\partial V_2(t_2)}{\partial V_2(0)}\Delta V_2(0) \tag{11}$$

where $t_2$ is the time length required for the threshold voltage detecting process and $V_2(0)$ is the initial value of the source potential $V_2$. Here, the initial value $V_2(0)$ can be represented as:

$$V_2(0) = V_1(t_1) + \Delta V_{pow} \tag{12}$$

where $\Delta V_{pow}$ is a variation (which is a constant) of the source potential caused by the potential variation on the cathode potential line 17 at the start of the threshold voltage detecting process. Then, when Expressions (8) and (10) are assigned to Expression (13), the relation $$\Delta V_{th} = \frac{\frac{\beta}{2(C_s + C_{OLED})}}{\left(\frac{1}{V_2(0) + V_{th}} - \frac{\beta}{2(C_s + C_{OLED})}t_2\right)^2}\Delta t^2 - \frac{1}{(V_2(0) + V_{th})^2\left(\frac{1}{V_2 + V_{th}} - \frac{\beta}{2(C_s + C_{OLED})}t_2\right)^2} \times \frac{\frac{\beta \cdot V_{data}'^2}{C_{OLED}} \cdot \exp\left(-\frac{\beta \cdot V_{data}'}{C_{OLED}} t_1 + \ln\left(1 + \frac{V_{data}'}{V_1(0)}\right)\right)}{\left(\exp\left(-\frac{\beta \cdot V_{data}'}{C_{OLED}} t_1 + \ln\left(1 + \frac{V_{data}'}{V_1(0)}\right)\right) - 1\right)^2}\Delta t_1 \tag{14}$$

is derived. When the capacitance of the capacitor 5, and the specific structure or the like of the thin film transistor 4 are determined so that the value of $\Delta V_{th}$ of Expression (14) satisfies Expression (5) for any value of $V_{data}'$ of the display device of the embodiment, even if the pixel circuits in adjacent rows share the cathode potential line 17, the first control line 18, and the second control line 19, and the entire screen intends to display the same color, the variation in displayed color among pixel circuits 1 arranged in the adjacent rows can be suppressed to a visually unrecognizable level.

The specific structure of the pixel circuits of the display device where the interconnection elements such as the cathode potential line is shared among plural pixel circuits arranged in different rows is not limited to the one shown in FIG. 1. For example, it is possible to suppress the variation in displayed color to a visually unrecognizable level with the use of the interconnection structure of a pixel circuit 23 of a first modification shown in FIG. 4 in the same manner as in FIG. 1.

Figure 4:
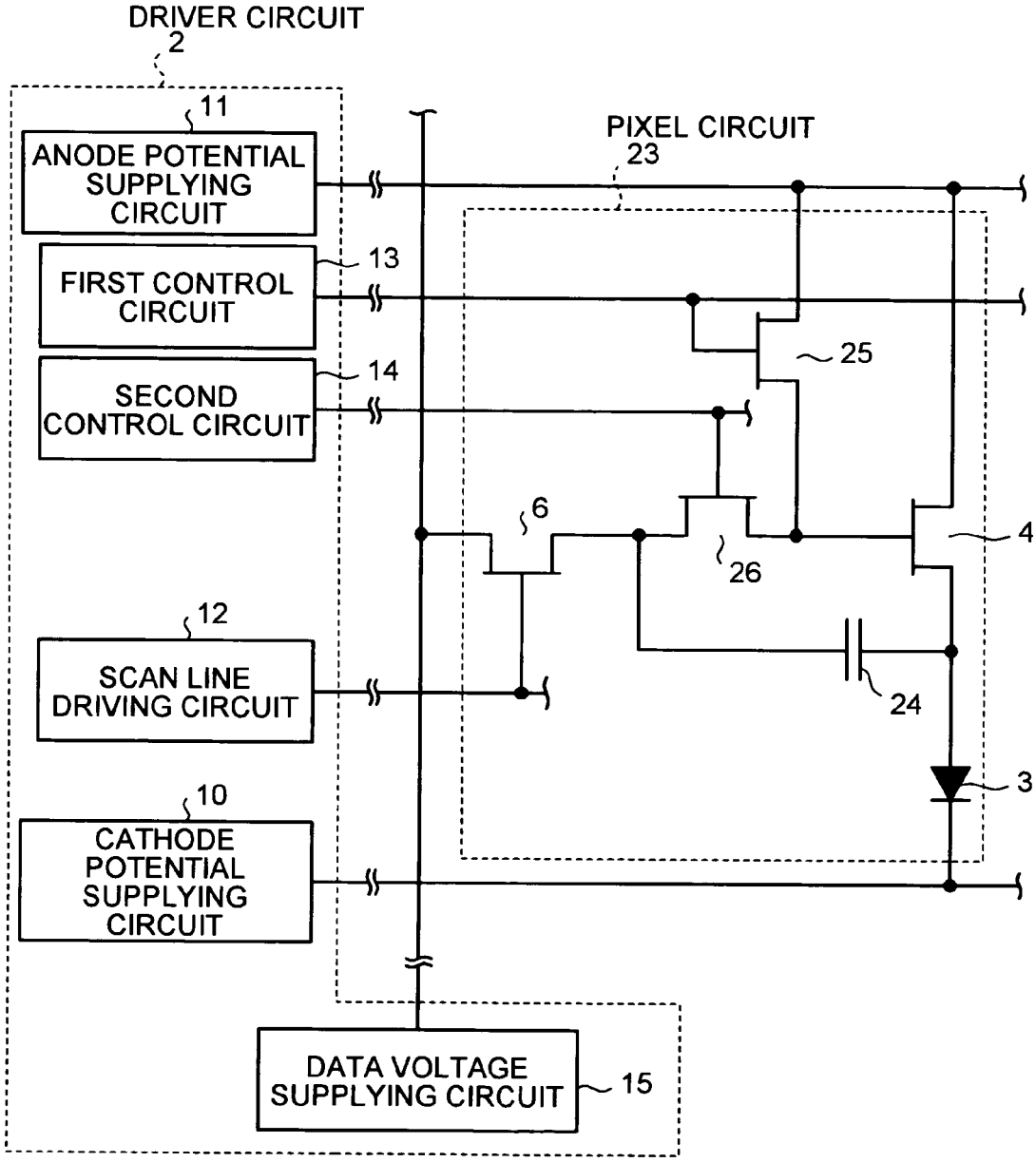
FIG. 4 is a circuit diagram of a structure of a pixel circuit according to a modification of the embodiment.

The pixel circuit 23 shown in FIG. 4, being different from the pixel circuit 1, includes a second switching element 25 arranged between the gate and the drain of the thin film transistor 4, a third switching element 26 arranged between the thin film transistor 4 and the first switching element 6, and a capacitor 24 arranged between one source/drain electrode of the first switching element 6 (i.e., the source/drain electrode on the side not electrically connected to the data voltage supplying circuit 15) and the anode of the OLED 3. With such pixel circuit 23, if the capacitor 5 of the circuit in FIG. 1 is replaced with the capacitor 24 and the whole circuit structure is designed as to satisfy Expression (10) and to allow the sharing of interconnection structure, it is possible to suppress the variation in displayed colors to a visually unrecognizable level.

Figure 5:
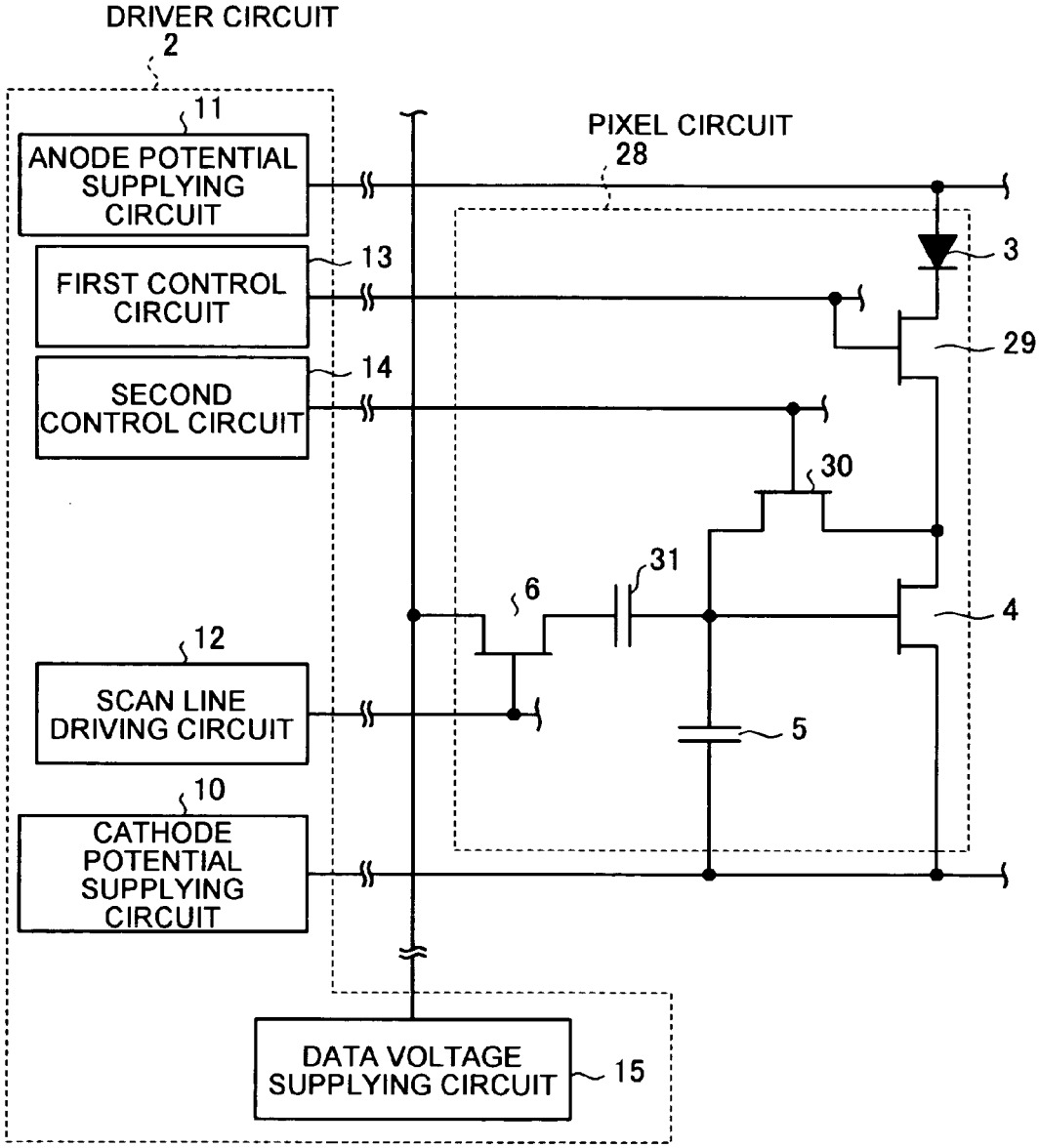
FIG. 5 is a circuit diagram of a structure of a pixel circuit according to another modification of the embodiment.

In addition, a pixel circuit 28 of a second modification shown in FIG. 5 allows the suppression of variation in displayed color to a visually unrecognizable level while allowing the sharing of the interconnection structure. Specifically, in the pixel circuit 28 of FIG. 5, the anode side of the OLED 3 is electrically connected to the anode potential supplying circuit 11 not via the thin film transistor 4, and the pixel circuit 28 includes a second switching element 29 arranged between the cathode side of the OLED 3 and the drain electrode of the thin film transistor 4, a third switching element 30 arranged between the gate and the drain of the thin film transistor 4, a capacitor 31 arranged between the gate electrode of the thin film transistor 4 and one source/drain electrode (the source/drain electrode on the opposite side to the source/drain electrode connected to the data voltage supplying circuit 15) of the first switching element 6. In such pixel circuit 28, $(C_S+C_{OLED})$ in Expression (10) is replaced with the sum of $C_S$ and the capacitance $C_1$ of the capacitor 31. Then, when the electric current $I_{vth}$ flowing through the thin film transistor 4 during the driving threshold detecting process is approximated as:

$$I \approx \alpha(V_{DD}-V_1-V_{th})^2 \tag{15}$$

where $V_{DD}$ is the potential supplied from the anode potential line and $\alpha$ is a predetermined proportion factor, Expression (16) holds:

$$\alpha(V_{DD}-V_1-V_{th,OLED})^2 = \frac{\beta}{2}(V_1-V_{th})^2 + (C_1+C_{OLED})\frac{dV_1}{dt} \tag{16}$$

By solving the differential Equation (16), a display device which suppresses the variation in displayed colors to a visually unrecognizable level as the embodiment can be realized.

Figure 6:
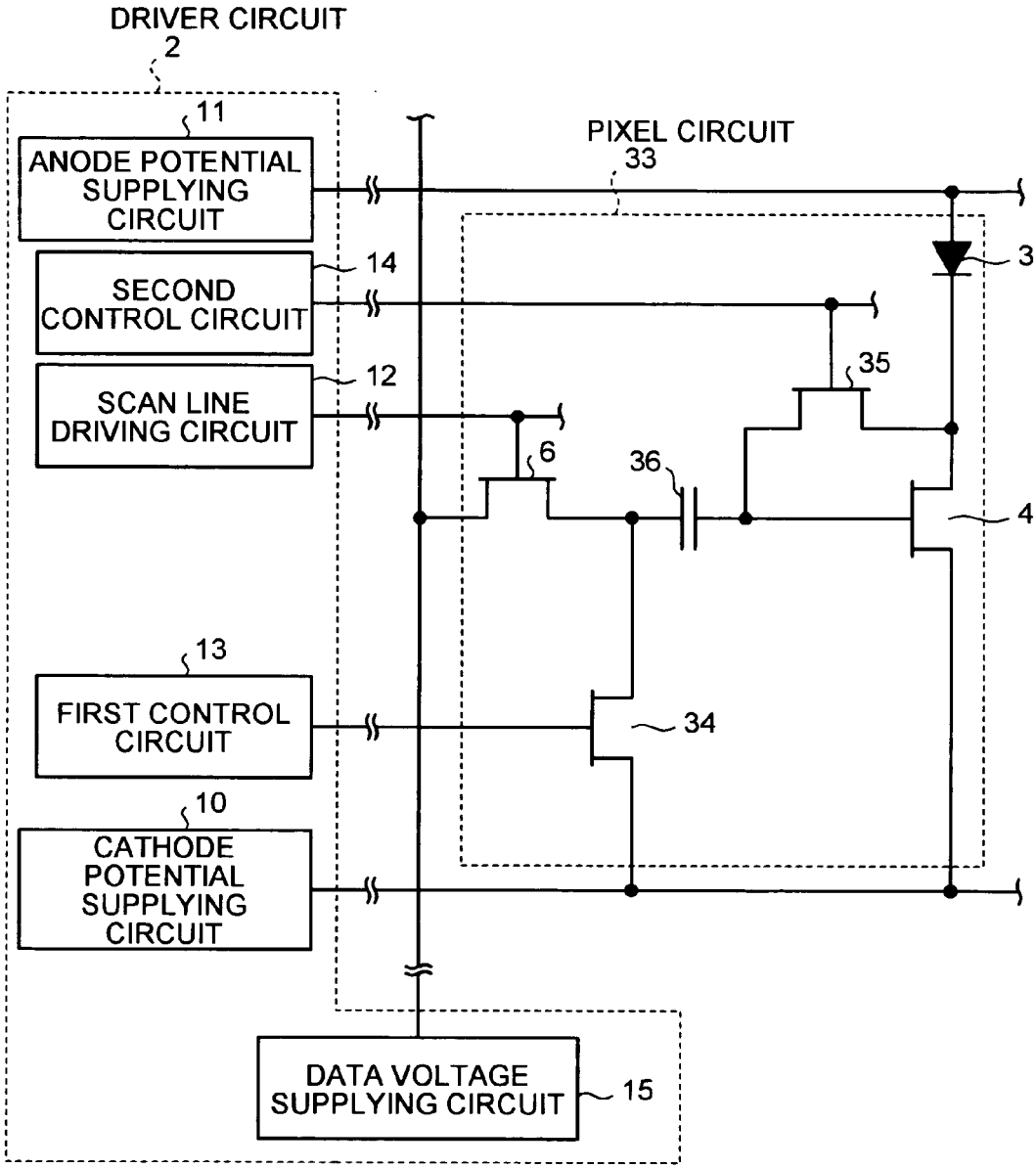
FIG. 6 is a circuit diagram of a structure of a pixel circuit according to still another modification of the embodiment.
Figure 7:
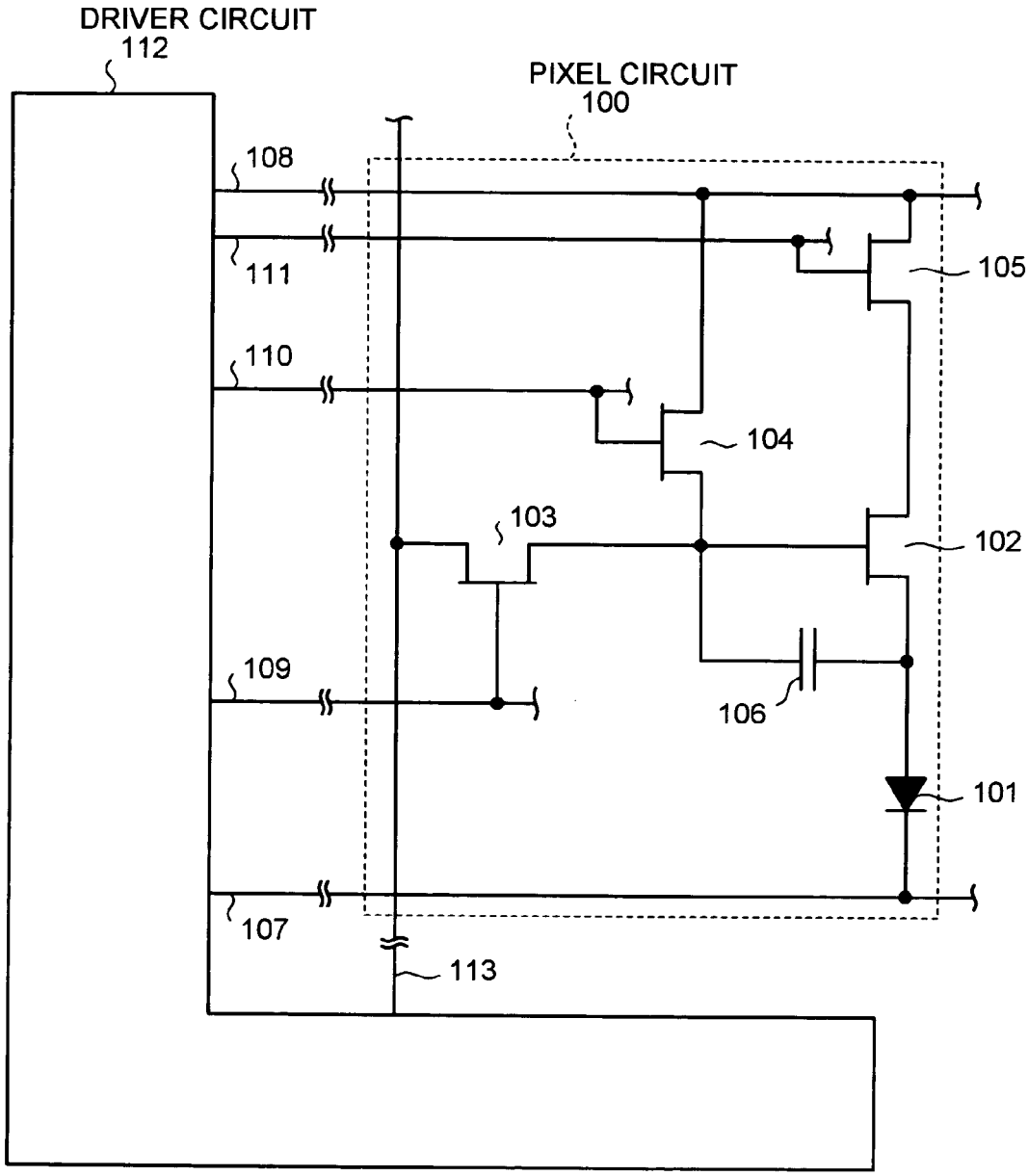
FIG. 7 is a schematic diagram of a structure of a conventional display device.

A pixel circuit 33 of FIG. 6 can also be employed. The pixel circuit 33 includes a second switching element 34 controlling electrical connection between one source/drain electrode of the first switching element (a source/drain electrode opposite to the source/drain electrode connected to the data voltage supplying circuit 15) and the cathode potential supplying circuit 10, a third switching element 35 arranged between the gate and the drain of the thin film transistor 4, and a capacitor 36 arranged between the thin film transistor 4 and the first switching element 6. The display device including such pixel circuit 33 can be realized as a display device suppressing the variation in displayed colors to a visually unrecognizable level through similar calculations concerning the drain potential as in the embodiment and the first modification.

In the foregoing, the embodiment and the modifications of the present invention are described. The present invention is, however, not limited to the embodiment and the modifications and various embodiments or modifications may be readily conceived by those skilled in the art. For example, though in the embodiment the n-channel thin film transistor 4 is employed as an example of a transistor element, the structure of the transistor is not limited thereto and, for example, a p-type thin film transistor can be employed.

In addition, an OLED or the like can be employed as the light-emitting element instead of the OLED. It is not essential that the light-emitting element has the function as a capacitance. It is possible to separately provide a light-emitting element which does not have a function as a capacitor and a capacitance which serves to accumulate the electric charges in the electric charge accumulating process.

What is claimed is:

1. A display device comprising:

a plurality of pixel circuits, arranged in a matrix, each of which includes a light-emitting element that emits light with a luminance depending on an injected electric current, and a transistor that controls the electric current flowing through the light-emitting element, each of the pixel circuits performing prior to emission of light by the light-emitting element an electric charge accumulating operation in which a voltage between a gate and a source of the transistor is raised to a level higher than a driving threshold voltage of the transistor through accumulation of electric charges to a predetermined capacitor, and each of the pixel circuits performing a voltage detecting/supplying operation in which a voltage corresponding to the driving threshold voltage is detected/supplied between the gate and the source of the transistor through adjustment of the voltage between the gate and the source; and a driver circuit that controls at least a timing of detection and supply of a voltage corresponding to electric charge accumulation and the driving threshold voltage in the pixel circuit, wherein the driver circuit controls so that the electric charge accumulation and the voltage detection/supply start substantially simultaneously for a pixel circuit in a first row in the matrix and a pixel circuit in a second row in the matrix and adjacent to the pixel circuit in the first row in one direction along a column, and controls so that the electric charge accumulation and the voltage detection/supply end substantially simultaneously for the pixel circuit in the first row and a pixel circuit in a third row and adjacent to the pixel circuit in the first row in another direction along the column.

2. The display device according to claim 1 wherein the driver circuit controls so that amounts of time differences in end timings of the electric charge accumulation and the voltage detection/supply between the pixel circuit in the first row and the pixel circuit in the second row are substantially equal to amounts of time differences in start timings of the electric charge accumulation and the voltage detection/supply between the pixel circuit in the first row and the pixel circuit in the third row.

3. The display device according to claim 1, wherein the light-emitting element has a characteristic that the light-emitting element emits light on receiving a supply of voltage in a forward direction which causes electric current in the light-emitting element, and accumulates electric charges corresponding to a level of supplied voltage on receiving a supply of voltage in a backward direction, and functions as the capacitance at the electric charge accumulation and the voltage detection/supply.

4. The display device according to claim 1, wherein the light-emitting element is an organic light-emitting diode.

5. A method of driving a display device which includes plural pixel circuits, arranged in a matrix, each of which includes a light-emitting element that emits light with a luminance depending on an injected electric current and a transistor that controls the electric current flowing through the light-emitting element, and which is configured to accumulate electric charges to a predetermined capacitor and to employ the accumulated electric charges to detect/supply a voltage corresponding to a driving threshold voltage between a gate and a source of the transistor element prior to emission of light by the light-emitting element, the method comprising:

starting an electric charge accumulation and a voltage detection/supply substantially simultaneously for the pixel circuit arranged in a first row in the matrix and for the pixel circuit arranged in a second row adjacent to the first row in one direction along a column direction; and stopping the electric charge accumulation and the voltage detection/supply substantially simultaneously for the pixel circuit arranged in the first row in the matrix and the pixel circuit arranged in a third row adjacent to the first row in another direction along the column direction.

6. The method according to claim 5, wherein the light-emitting element is an organic light-emitting diode.

* * * * *